US010328437B2

(12) United States Patent
Umase

(10) Patent No.: US 10,328,437 B2
(45) Date of Patent: Jun. 25, 2019

(54) ELECTROSTATIC PRECIPITATOR, CHARGE CONTROL PROGRAM FOR ELECTROSTATIC PRECIPITATOR, AND CHARGE CONTROL METHOD FOR ELECTROSTATIC PRECIPITATOR

(71) Applicant: MITSUBISHI HITACHI POWER SYSTEMS ENVIRONMENTAL SOLUTIONS, LTD., Yokohama-Shi, Kanagawa (JP)

(72) Inventor: Shigeki Umase, Kobe (JP)

(73) Assignee: MITSUBISHI HITACHI POWER SYSTEMS ENVIRONMENTAL SOLUTIONS, LTD., Yokohama-shi (JP)

( * ) Notice: Subject to any disclaimer, the term of this patent is extended or adjusted under 35 U.S.C. 154(b) by 213 days.

(21) Appl. No.: 15/113,652

(22) PCT Filed: Jan. 29, 2014

(86) PCT No.: PCT/JP2014/052003

§ 371 (c)(1),
(2) Date: Jul. 22, 2016

(87) PCT Pub. No.: WO2015/114762

PCT Pub. Date: Aug. 6, 2015

(65) Prior Publication Data

US 2017/0008008 A1 Jan. 12, 2017

(51) Int. Cl.
*B03C 3/68* (2006.01)
*B03C 3/09* (2006.01)
(Continued)

(52) U.S. Cl.
CPC ..... *B03C 3/68* (2013.01); *B03C 3/09* (2013.01); *B03C 3/41* (2013.01); *B03C 3/47* (2013.01); *B03C 2201/04* (2013.01)

(58) Field of Classification Search
CPC combination set(s) only.
See application file for complete search history.

(56) References Cited

U.S. PATENT DOCUMENTS 3,147,094 A * 9/1964 Hall ..... B03C 3/68 323/903
3,443,358 A * 5/1969 Thomas ..... B03C 3/66 315/291

(Continued)

FOREIGN PATENT DOCUMENTS

FR 2 503 583 A1 10/1982
JP 59105858 A * 6/1984 ..... B03C 3/763

(Continued)

OTHER PUBLICATIONS

International Search Report dated Apr. 28, 2014, issued in counterpart international application No. PCT/JP2014/052003(2 pages).

(Continued)

*Primary Examiner* — Amber R Orlando
*Assistant Examiner* — Sonji Turner
(74) *Attorney, Agent, or Firm* — Westerman, Hattori, Daniels & Adrian, LLP

(57) ABSTRACT

In a charging time period T1, a dry electrostatic precipitator outputs DCON that is a current for charging a collection target object from a high voltage power supply. Subsequently, in a second period of time T2-2 after a first period of time T2-1 passes from a time that a charging pause time period T2 starts, the dry electrostatic precipitator outputs DCBC that is a current that is less than DCON and is greater than a current in the first period of time T2-1, from the high voltage power supply.

1 Claim, 5 Drawing Sheets

(51) Int. Cl.
*B03C 3/41* (2006.01)
*B03C 3/47* (2006.01)

(56) References Cited

U.S. PATENT DOCUMENTS

| | | | | | |
|---|---|---|---|---|---|
| 4,047,235 | A * | 9/1977 | Davis | H02H 3/093 | 323/243 |
| 4,410,849 | A * | 10/1983 | Ando | B03C 3/68 | 323/237 |
| 4,445,911 | A * | 5/1984 | Lind | B03C 3/66 | 323/903 |
| 4,502,002 | A | 2/1985 | Ando | | |
| 4,592,763 | A * | 6/1986 | Dietz | B03C 3/68 | 323/271 |
| 4,626,260 | A * | 12/1986 | Jorgensen | B03C 3/68 | 323/903 |
| 4,648,887 | A | 3/1987 | Noda et al. | | |
| 4,690,694 | A * | 9/1987 | Alig | B03C 3/68 | 95/3 |
| 5,068,811 | A * | 11/1991 | Johnston | B03C 3/68 | 323/241 |
| 5,321,274 | A * | 6/1994 | Yeh | B03C 3/68 | 250/573 |
| 5,378,978 | A * | 1/1995 | Gallo | B03C 3/68 | 323/241 |
| 5,477,464 | A * | 12/1995 | Jacobsson | B03C 3/68 | 323/903 |
| 5,639,294 | A * | 6/1997 | Ranstad | B03C 3/68 | 323/903 |
| 5,757,169 | A * | 5/1998 | Terai | B03C 3/66 | 323/241 |
| 2005/0178265 | A1* | 8/2005 | Altman | B03C 3/68 | 95/2 |
| 2008/0264249 | A1* | 10/2008 | Truce | B03C 3/68 | 95/6 |
| 2012/0281440 | A1* | 11/2012 | Hayashi | H02M 1/36 | 363/21.15 |
| 2013/0074690 | A1* | 3/2013 | Tomimatsu | B01D 46/02 | 95/26 |
| 2014/0319102 | A1* | 10/2014 | Okane | B23H 1/022 | 219/69.13 |
| 2016/0279646 | A1* | 9/2016 | Aufreiter | B03C 3/68 | |

FOREIGN PATENT DOCUMENTS

| | | | |
|---|---|---|---|
| JP | 60-58251 | A | 4/1985 |
| JP | 60161757 | A * | 8/1985 |
| JP | 61185352 | A * | 8/1986 |
| JP | 62-106642 | U | 7/1987 |
| JP | 5-55191 | B2 | 8/1987 |
| JP | 1-194953 | A | 8/1989 |
| JP | 3643062 | B2 | 4/2005 |
| JP | 2010-29740 | A | 2/2010 |

OTHER PUBLICATIONS

Written Opinion dated Apr. 28, 2014 issued in counterpart application No. PCT/JP2014/052003 with English Translation(8 pages).
Extended (Supplementary) European Search Report dated Nov. 29, 2016, issued in counterpart European Patent Application No. 14880840.5. (13 pages).

* cited by examiner

ELECTROSTATIC PRECIPITATOR, CHARGE CONTROL PROGRAM FOR ELECTROSTATIC PRECIPITATOR, AND CHARGE CONTROL METHOD FOR ELECTROSTATIC PRECIPITATOR

TECHNICAL FIELD

The present invention relates to an electrostatic precipitator, a charge control program for an electrostatic precipitator, and a method of charging an electrostatic precipitator.

BACKGROUND ART

A power generation plant that burns coal or the like, or processing of raw materials for iron making performed by a sintering machine or the like discharge exhaust gas that includes dust (particulate matter). To remove such dust, an electrostatic precipitator that collects dust contained in exhaust gas by means of an electrostatic force (also referred to as "dust collection") is provided in a flue on a downstream side of the combustion facility. The electrostatic precipitator applies a high voltage between a charging portion constituted by a discharge electrode and an earth electrode as a dust-collecting electrode, imparts a positive or negative charge to dust contained in gas by means of corona discharge, and thereby charges the dust.

In this case, if corona, discharge is generated between a dust-collecting electrode at which high-resistance dust has accumulated and a discharge electrode, a back-corona phenomenon whereby dielectric breakdown occurs in a dust layer is liable to occur. If the back corona phenomenon occurs, the dust collection performance decreases significantly.

Therefore, in charge control of an electrostatic precipitator, in order to suppress the occurrence of a decrease in the dust collection performance that accompanies back corona, an intermittent charging method is adopted in which a charging pause time period is provided, and which alternately repeats a charging time period and the charging pause time period to perform intermittent charging (PTL 1 to 3).

According to such kind of intermittent charging method, in a state in which the occurrence of back corona is noticeable and there is a marked decrease in the dust collection performance, a long charging pause time period is adopted to thereby improve the dust collection performance. However, during the charging pause time period, the size of a current that flows to an electrode cannot be adjusted. Therefore, when a long charging pause time period is adopted, the voltage for charging (potential difference between the electrodes) decreases and this leads to a decrease in the dust collection performance of the electrostatic precipitator.

Therefore, in PTL 3, technology is disclosed that improves the dust collection performance with respect to high-resistance dust by forming an electrical field between a dust-collecting electrode and a discharge electrode by allowing a low current of the required minimum amount to flow to dust during the charging pause time period.

CITATION LIST

Patent Literature

{PTL 1}
The Publication of Japanese Patent No. Hei 5-55191
{PTL 2}
The Publication of Japanese Patent No. 3643062

{PTL 3}
Japanese Unexamined Patent Application, Publication No. Sho 60-58251

SUMMARY OF INVENTION

Technical Problem

However, according to the intermittent charging method disclosed in PTL 3, even during a charging pause time period, particularly at the start of the charging pause time period, an electric field is formed and there is the possibility of back corona occurring, although the potential difference between the electrodes is less than during a charging time period.

The present invention has been made in consideration of the above described situation, and an object of the present invention is to provide an electrostatic precipitator, a charge control program for an electrostatic precipitator, and a charge control method for an electrostatic precipitator which suppress the occurrence of back corona and also suppress a decrease in dust collection performance caused by a charging pause during intermittent charging.

Solution to Problem

To solve the above problems, the electrostatic precipitator, charge control program for an electrostatic precipitator, and charge control method for an electrostatic precipitator of the present invention adopt the following solutions.

An electrostatic precipitator according to a first aspect of the present invention collects a collection target object contained in a gas by means of an electrostatic force, and includes: a first electrode and a second electrode that are arranged to oppose each other along a circulation direction of the gas, and that form an electrical field for charging the collection target object; and a power supply that applies a potential difference between the first electrode and the second electrode so as to repeat a charging time period and a charging pause time period; wherein, in a second period of time after a first period of time passes from a time that the charging pause time period starts, the power supply outputs a current that is less than a current in the charging time period and is greater than a current in the first period of time.

The electrostatic precipitator according to the present configuration collects a collection target object contained in a gas by means of an electrostatic force. Note that the collection target object is, for example, soot dust contained in the gas.

The first electrode and the second electrode that form an electrical field for charging a collection target object are arranged to oppose each other along a circulation direction of the gas. The collection target object is removed from the gas by being collected at an electrode by means of an electrostatic force.

Further, a potential difference is applied between the first electrode and the second electrode by the power supply so as to repeat, a charging time period and a charging pause time period. That is, intermittent charging is performed in which charging is performed intermittently by alternately repeating a charging time period and a charging pause time period. The charging pause time period is provided for the purpose of not causing back corona to occur.

In this case, if the charging pause time period is long, it leads to a decrease in the dust collection performance of the electrostatic precipitator. Further, if a potential difference that is less than a potential difference applied in the charging time period is applied in a fixed time period after the charging pause time period starts, the effect of suppressing the occurrence of back corona decreases.

Therefore, in the second period of time after the first period of time passes from that time that the charging pause time period starts, the power supply according to the present configuration outputs a current that is less than a current in the charging time period and is greater than the current in the first period of time. That is, the charging pause time period is divided into a first period of time and a second period of time. In the first period of time, the output of a current from the power supply is stopped. On the other hand, in the second period of time, a current that is less than the current in the charging time period and is greater than the current in the first period of time is output. The output current in the second period of time is, in other words, a current that generates a potential difference between the electrodes that is less than a threshold value at which back corona occurs. That is, in the second period of time that is part of the charging pause time period, a voltage for forming a weak electrical field that does not cause the occurrence of back corona is output from the power supply. Thereby, a decrease in the dust collection performance during the charging pause time period is suppressed.

As described above, the present configuration can suppress the occurrence of back corona and can also suppress a decrease in dust collection performance caused by a charging pause during intermittent charging.

In the above described first aspect, preferably, in a case where a slope of an output voltage decrease after a time that the charging pause time period starts becomes equal to or less than a prescribed value, the power supply increases an output current so as to obtain an output voltage that is equal to or less than the prescribed value and start the second period of time.

According to the present configuration, in a case where a slope of an output voltage decrease after the start of the charging pause time period is equal to or less than a prescribed value, it is determined that the voltage (potential difference) is of a level that does not cause back corona to occur, and the output current from the power supply is controlled so as to maintain the output voltage at this point. Thereby, the value of the output voltage in the second period of time can be made an appropriate value. Note that, the reason for using the slope of an output voltage decrease to determine a voltage at which back corona does not occur is because the size of a voltage that does not cause back corona to occur varies depending on the characteristics of the apparatus and the state of a load; it is difficult to determine the size of the aforementioned voltage in advance.

In the above described first aspect, preferably, in a case where a slope of an output voltage decrease becomes equal to or less than the prescribed value, the power supply adjusts the current so as to obtain a previously determined voltage value.

According to the present configuration, as output voltage in the second period of time can be made an appropriate size earlier.

In the above described first aspect, preferably an operating frequency of the power supply is a medium or higher frequency.

According to the present configuration, the power supply can output an appropriate voltage earlier in the second period of time.

A charge control program for an electrostatic precipitator according to a second aspect of the present invention is a charge control program for an electrostatic precipitator including a first electrode and a second electrode that are arranged to oppose each other along a circulation direction of a gas and that form an electrical field for charging a collection target object contained in the gas, and a power supply that applies a potential difference between the first electrode and the second electrode so as to repeat a charging time period and a charging pause time period, and collecting the collection target object by means of an electrostatic force; wherein the charge control program causes a computer to function as: a first output means for, in the charging time period, causing a predetermined current for charging the collection target object to be output from the power supply; and a second output means for determining a first period of time from a time that the charging pause time period starts, and in a second, period of time after the first period of time passes, determining a current that is less than the current in the charging time period and is greater than a current in the first period of time, and causing the current that is determined to be output from the power supply.

A charge control method for an electrostatic precipitator according to a third aspect of the present invention is a charge control method for an electrostatic precipitator including a first electrode and a second electrode that are arranged to oppose each other along a circulation direction of a gas and that form an electrical field for charging a collection target object contained in the gas, and a power supply that applies a potential difference between the first electrode and the second electrode so as to repeat a charging time period and a charging pause time period, and collecting the collection target object by means of an electrostatic force; the charge control method including: in the charging time period, outputting a predetermined current for charging the collection target object from the power supply; and in a second period of time after a first period of time passes from a time that the charging pause time period starts, outputting a current that is less than the current in the charging time period and is greater than a current in the first period of time from the power supply.

Advantageous Effects of Invention

According to the present invention, there are the excellent advantageous effects of suppressing occurrence of back corona and also suppressing a decrease in dust collection performance caused by a charging pause during intermittent charging.

DESCRIPTION OF EMBODIMENTS

Hereunder, an embodiment of the electrostatic precipitator, the charge control program for an electrostatic precipitator, and the charge control method for an electrostatic precipitator according to the present invention will be described with reference to the accompanying drawings.

Figure 1:
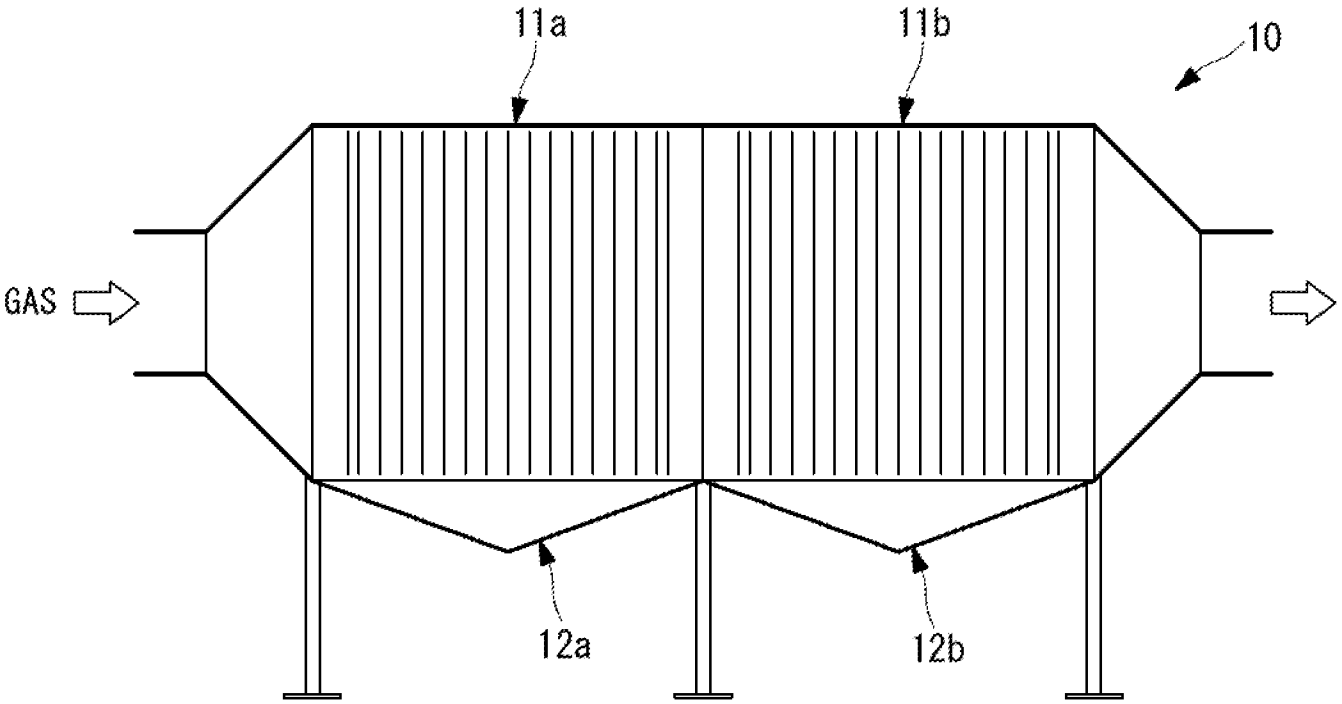
FIG. 1 is a schematic diagram of a dry electrostatic precipitator according to an embodiment of the present invention.

FIG. 1 is a schematic diagram of a dry electrostatic precipitator 10 according to the present embodiment. The dry electrostatic precipitator 10 includes two electric field formation portions 11*a* and 11*b* that are arranged so as to be in series in the circulation direction of a gas. Combustion exhaust gas flows in from the left side of the dry electrostatic precipitator 10 and passes through the electric field formation portions 11*a* and 11*b* and is discharged from the right side. A collection target object (also referred to as "dust collected inside the ESP") is temporarily accumulated in hoppers 12*a* and 12*b* provided below the electric field formation portions 11*a* and 11*b*, and is periodically carried out by ash handling equipment. Note that, although two electric field formation portions are provided in the dry electrostatic precipitator 10 illustrated in FIG. 1, one or three or more electric field formation portions may be provided according to the required performance of the dry electrostatic precipitator 10.

Figure 2:
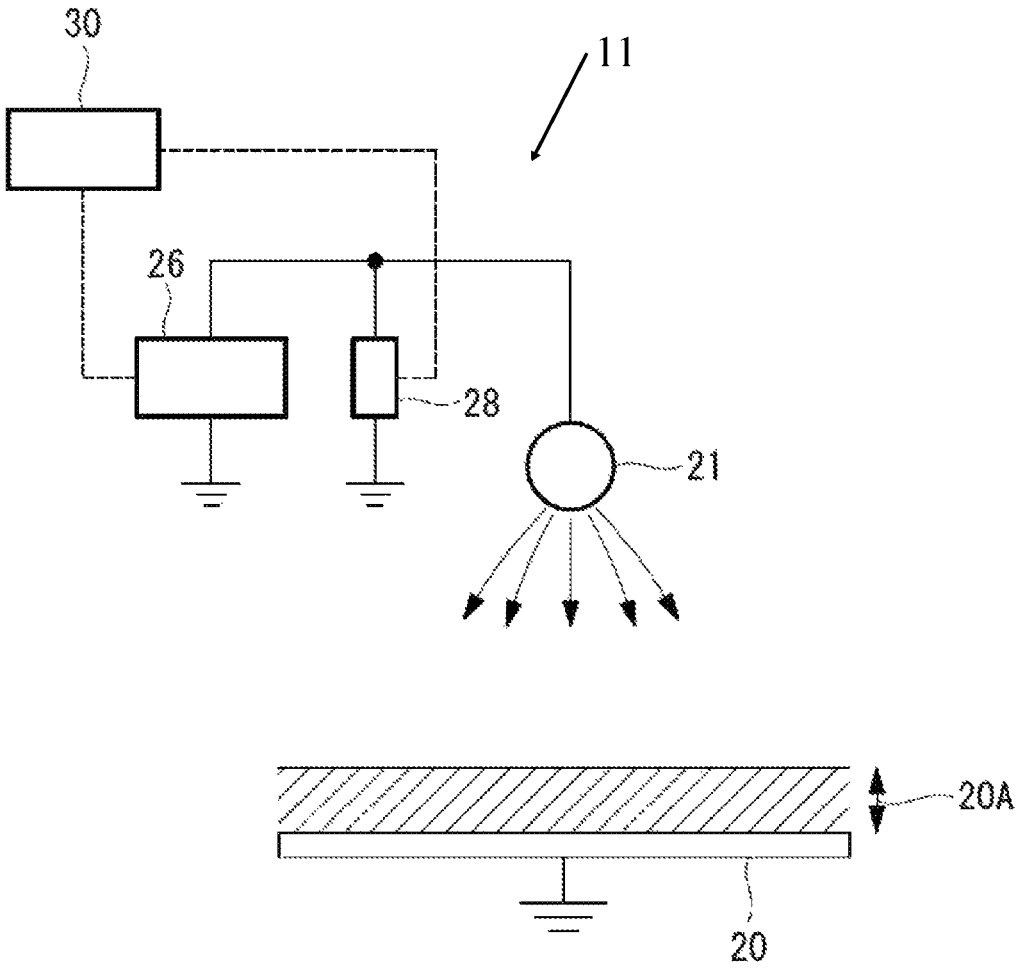
FIG. 2 is an enlarged schematic diagram of an electric field formation portion of the dry electrostatic precipitator according to the embodiment of the present invention.

FIG. 2 is an enlarged schematic diagram of one electric field formation portion 11 of the dry electrostatic precipitator 10 according to the present embodiment.

The electric field formation portion 11 includes an earth electrode 20 and an application electrode 21 which are arranged to oppose each other, and forms an electrical field (also referred as "dust layer collected inside the ESP") for charging the dust collected inside the ESP. The dust collected inside the ESP is collected at an electrode by means of an electrostatic force to thereby remove the dust from the combustion exhaust gas. Although one pair of the earth electrode 20 and the application electrode 21 are illustrated in FIG. 2, normally a plurality of the application electrodes 21 are alternately disposed with respect to one earth electrode 20.

The application electrode 21 is connected to a high voltage power supply 26, and a voltage is applied thereto from the high voltage power supply 26.

The dust collected inside the ESP that is collected at a dust layer collected inside the ESP 20A that is formed at the earth electrode 20 detaches from the earth electrode 20 upon the performance of rapping of the earth electrode 20 at a preset cycle. The dust collected inside the ESP that detaches from the earth electrode 20 drops down and accumulates in the hoppers 12*a* and 12*b* and is carried out. Note that, in a case where, in the dust layer collected inside the ESP 20A, a specific electrical resistance of the dust collected inside the ESP is a high resistance that exceeds $10^{11}$ to $10^{12}$ Ω-cm, the voltage of the dust layer collected inside the ESP 20A becomes noticeably high, and in some cases a so-called "back corona phenomenon" occurs which is a dielectric breakdown in the dust layer collected inside the ESP 20A, and the dust collection performance decreases.

The operating frequency of the high voltage power supply 26 according to the present embodiment is, for example, a medium frequency (100 Hz) or higher, or is a switchmode power supply (SMPS) that operates at a high frequency (10 kHz or more). By adopting a frequency that is equal to or higher than a medium frequency as the operating frequency of the high voltage power supply 26, an intermittent charging method according to the present embodiment that is described in detail later can be performed with a high degree of accuracy in msec units. Note that, an output voltage of the high voltage power supply 26 is measured by a voltage sensor 28.

The size of a current that the high voltage power supply 26 outputs is controlled by a power supply control apparatus 30. Further, a value of an output voltage that is measured by the voltage sensor 28 is input to the power supply control apparatus 30.

The power supply control apparatus 30 is constituted by, for example, a CPU (Central Processing Unit), a RAM (Random Access Memory), a digital I/O, an analog I/O and a computer readable recording medium and the like. A series of processes for realizing various functions is, as one example, recorded in the form of a program on a recording medium or the like, and various functions are realized by the CPU reading out the program to the RAM or the like, and executing processing to manipulate and calculate information.

In the dry electrostatic precipitator 10, the high voltage power supply 26 generates a potential difference between the earth electrode and the application electrode 21 so as to repeat a charging time period and a charging pause time period. That is, the power supply control apparatus 30 controls the high voltage power supply 26 so as to perform intermittent charging that performs charging intermittently by alternately repeating a charging time period and a charging pause time period. Note that, the charging pause time period is provided for the purpose of not causing back corona to occur, and in the charging pause time period the output current from the high voltage power supply 26 is stopped or the output current is reduced in comparison to the charging time period.

Figure 3:
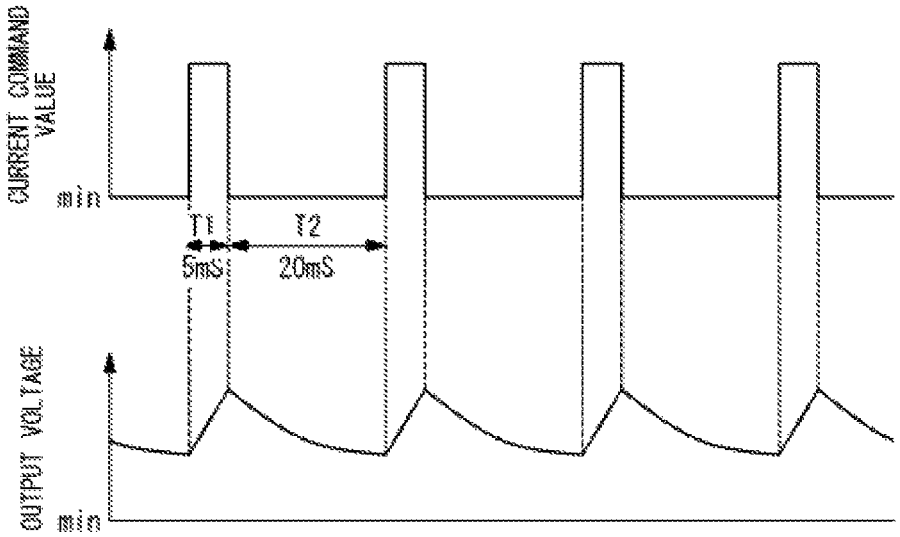
FIG. 3 PRIOR ART
FIG. 3 is a view illustrating changes over time in a current command value and an output voltage in a conventional intermittent charging method.

FIG. 3 is a view illustrating a conventional intermittent charging method, and shows changes over time (duty ratio) in a current command value from the power, supply control apparatus 30 and changes over time in an output voltage from the high voltage power supply 26.

In a charging time period T1, the power supply control apparatus 30 outputs a predetermined current command value for charging the collection target object to the high voltage power supply 26. Thus, the high voltage power supply 26 outputs a current that is in accordance with the current command value to thereby increase the output voltage. Note that the current command value is a value that is proportional to the output current from the high voltage power supply 26.

When the charging time period T1 passes, the power supply control apparatus 30 outputs a current command value for stopping the output of current to the high voltage power supply 26, to thereby transition to a charging pause time period T2. The term "stopping the output of current" refers to making the size of the output current approximately 0 (zero). As a result, the output voltage decreases.

Subsequently, when the charging pause time period T2 ends, the process transitions to the charging time period T1 again. Previously determined fixed values are adopted for the charging time period T1 and the charging pause time period T2. In FIG. 3, as one example, the charging time period T1 is set to 5 msec and the charging pause time period T2 is set to 20 msec.

In this case, if the charging pause time period T2 is long, it leads to a decrease in the dust collection performance of the dry electrostatic precipitator 10. Further, if a potential difference that is less than in the charging time period is applied in a fixed time period after the charging pause time period T2 starts, an effect of suppressing the occurrence of back corona decreases.

Figure 4:
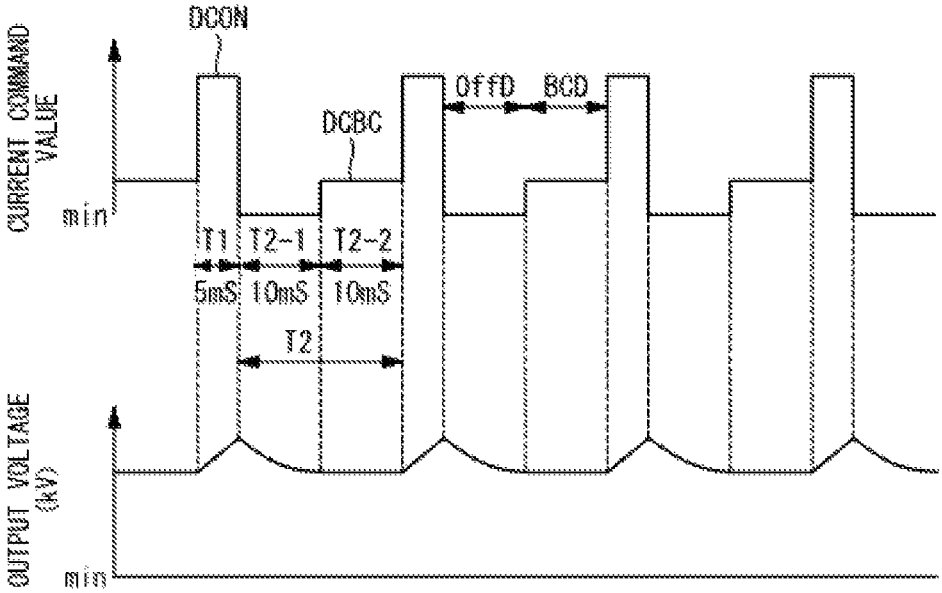
FIG. 4 is a view illustrating changes over time in a current command value and an output voltage in an intermittent charging method according to the embodiment of the present invention.

FIG. 4 is a view illustrating the intermittent charging method according to the present embodiment, and shows changes over time (duty ratio) in a current command value from the power supply control apparatus 30 and changes over time in an output voltage from the high voltage power supply 26.

The charging pause time period T2 according to the present embodiment is divided into a first period of time T2-1 and a second period of time T2-2. In the first period of time T2-1, the power supply control apparatus 30 outputs a current command value to the high voltage power supply 26 so as to stop the output of a current. Subsequently, in the second period of time T2-2 after the first period of time T2-1 passes, the power supply control apparatus 30 outputs a current command value to the high voltage power supply 26 so as to output a current that is less than the current in the charging time period T1 and is greater than the current in the first period of time T2-1.

The output current in the second period of time T2-2 is, in other words, a current that generates a potential difference between the earth electrode 20 and the application electrode 21 that is less than a threshold value at which back corona occurs. That is, in the second period of time T2-2 that is part of the charging pause time period T2, a voltage for forming a weak electrical field that does not cause back corona to occur is output from the high voltage power supply 26. Thereby, a decrease in the dust collection performance is suppressed in the charging pause time period T2.

When the charging pause time period T2 ends, the process transitions to the charging time period T1 again. Note that the charging time period T1 of 5 msec, and the first period of time T2-1 of 10 msec and the second period of time T2-2 of 10 msec in the time period T2 that are illustrated in FIG. 4 are represented as examples. In particular, the first period of time T2-1 and the second period of time T2-2 are not fixed values, and vary within the time range of the charging pause time period T2 as described in detail later.

Note that, in the following description, the current command value for the charging time period T1 is referred to as "DCON" (Duty Cycle during On Time), and the current command value for the second period of time T2-2 of the charging pause time period T2 is referred to as "DCBC" (Duty Cycle during Base Charging).

Further, a ratio between DCON and DCBC illustrated in Equation 1 is referred to as "BCLR" (Base Charging Level Ratio), and as one example a range of BCLR is from 0 to 50%.

{Equation 1}

$$BCLR(\%) = \frac{DCBC(\%)}{DCON(\%)} \tag{1}$$

Further, the duration of the first period of time T2-1 of the charging pause time period T2 is referred to as "OffD" (Off-time Duration), and the duration of the second period of time T2-2 of the charging pause time period T2 is referred to as "BCD" (Base Charging Duration).

Further, a ratio between OffD and BCD shown in Equation 2 is referred to as "BCDR" (Base Charging Duration Ratio), and as one example a range of BCDR is from 0 to 99%.

{Equation 2}

$$BCDR(\%) = \frac{BCD(mS)}{OffD(mS) + BCD(mS)} \tag{2}$$

Figure 5:
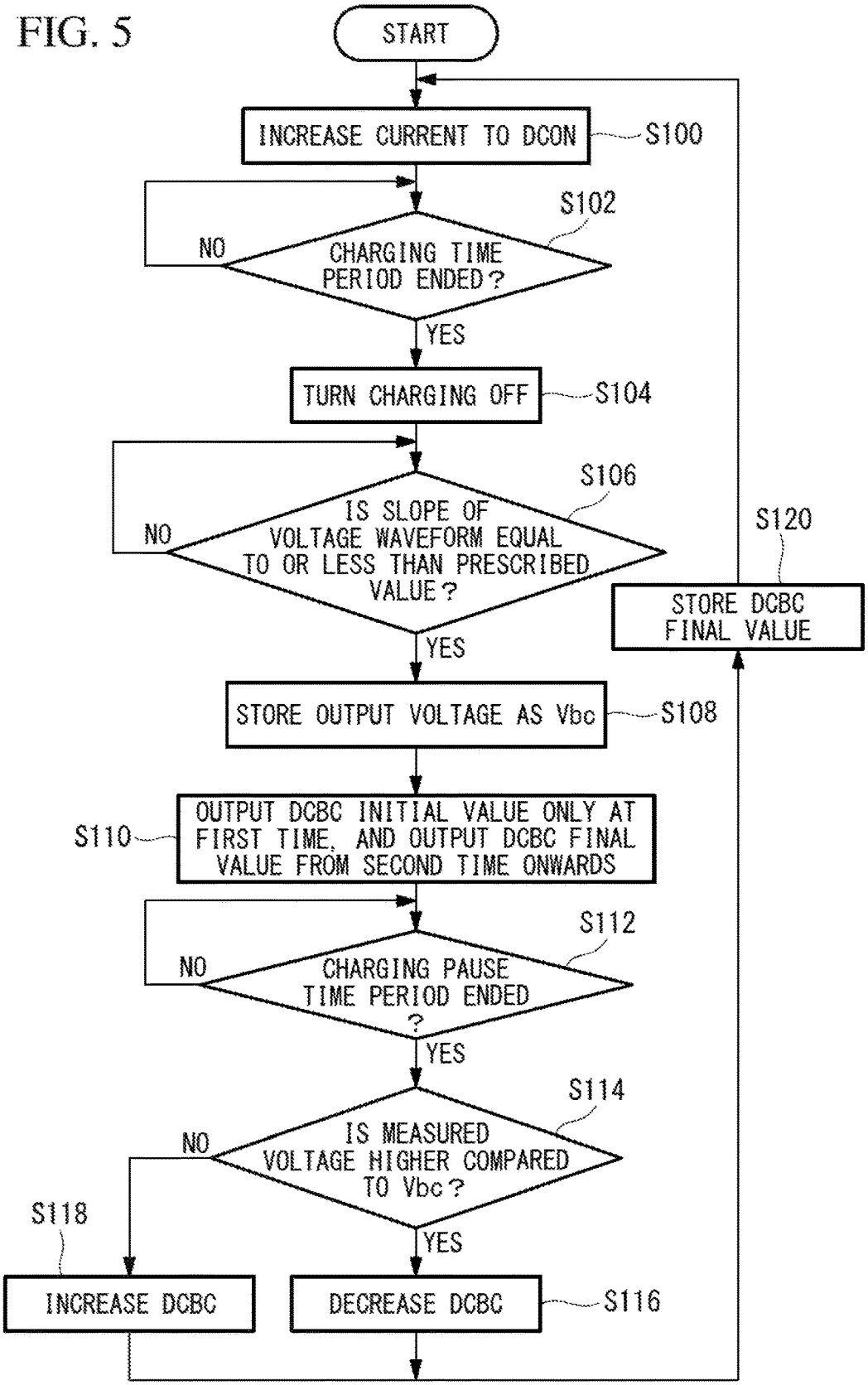
FIG. 5 is a flowchart illustrating the flow of processing that automatically sets parameters according to the embodiment of the present invention.

FIG. 5 is a flowchart illustrating a flow of processing for automatically setting current command values for the first period of time T2-1 and the second period of time T2-2 according to the present embodiment, which is processing of an intermittent charge control program executed by the power supply control apparatus 30 in a case of performing intermittent charging. The intermittent charge control program is previously stored in a predetermined region of the power supply control, apparatus 30. The intermittent charge control program is, for example, started together with the start of operation of an exhaust gas treatment apparatus 1.

First, in step 100, a current command value for increasing the output current to DCON is output to the high voltage power supply 26.

Next, in step 102, it is determined whether or not the charging time period T1 has ended. If the result determined in step 102 is affirmative, the processing transitions to step 104. If the result determined in step 102 is negative, a current command value for setting the output current to DCON continues to be output to the high voltage power supply 26 until the charging time period T1 ends.

In step 104, because the charging pause time period T2 is entered, a current command value for turning off charging, for example, a current command value that makes the output current 0 mA, is output to the high voltage power supply 26. As a result, the output voltage from the high voltage power supply 26 decreases.

Next, in step 106, it is determined whether or not a slope of a waveform of the output voltage (hereunder, referred to as "voltage waveform") from the high voltage power supply 26 has become equal to or less than a prescribed value. If the result determined in step 106 is affirmative, the processing transitions to step 108. On the other hand, if the result determined in step 106 is negative, the state in which charging is turned off is maintained.

In step 108, an output voltage Vbc in a case where the slope of the voltage waveform is equal to or less than the prescribed value is stored.

Next, in step 110, a current command value indicating DCBC is output to the high voltage power supply 26. Mote that, when performing the present control for the first time, a current command value indicating DCBC that is previously determined is output to the high voltage power supply 26 as an initial value. On the other hand, from the second time onwards, the final value (previous optimal value) of DCBC in the previous control is read out and output to the high voltage power supply 26. The high voltage power supply 26 outputs a current so as to obtain the initial value or previous optimal value of DCBC indicated by the current command value. Thereby, the second period of time T2-2 of the charging pause time period T2 is started.

That is, based on the slope of an output, voltage decrease, the first period of time T2-1 from the time that the charging; pause time period T2 starts is determined, and further, in the second period of time T2-2 after the passage of the first period of time T2-1, a current that is less than the current in the charging time period T1 and is greater than the current in the first period of time T2-1 is determined and is output from the high voltage power supply 26.

Next, in step 112, it is determined whether or not the charging pause time period T2 has ended. If the result determined in step 112 is affirmative, the processing transitions to step 114. On the other hand, if the result determined in step 112 is negative, the state in which DCBC is output is maintained.

In step 114, it is determined whether or not a voltage measured by the voltage sensor 28, that is, the present output voltage from the high voltage power supply 26, is higher than the voltage Vbc. If the result determined in step 114 is affirmative, the processing transitions to step 116, while if the result determined in step 114 is negative, the processing transitions to step 118.

In step 116, a current command value for decreasing the size of DCBC is output to the high, voltage power supply 26, and the processing transitions to step 120.

In step 118, a current command value for increasing the size of DCBC is output to the high voltage power supply 26, and the processing transitions to step 120.

In step 120, accompanying the end of the charging pause time period T2, the final value of DCBC at the end of the charging pause time period is stored as the optimal value, and the processing returns to step 100 to start the charging time period T1.

Thus, the charging time period T1 and the charging pause time period T2 which includes the first period of time T2-1 and second period of time T2-2 are repeated by means of the intermittent charge control program.

Figure 6:
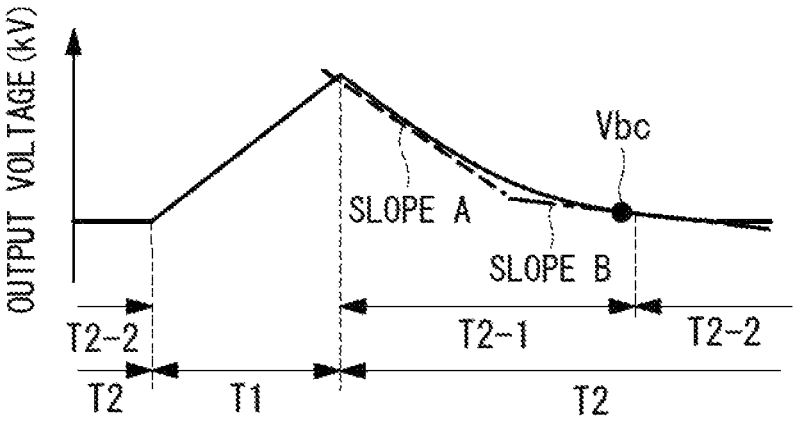
FIG. 6 is an enlarged view of changes over time in an output voltage in an intermittent charging method according to the embodiment of the present invention.

The processing in steps 106 to 118 will now be described with reference to FIG. 6. FIG. 6 is an enlarged view of changes over time in the output voltage in the intermittent charging method according to the present embodiment.

A slope A illustrated in FIG. 6 represents a slope that exceeds a prescribed value, and a slope B represents a slope that is equal to or less than a prescribed value. An output voltage on the slope B is denoted by Vbc.

That is, in a case where the slope of an output voltage decrease after the charging pause time period T2 starts has become less than or equal to a prescribed value, it is determined that the output voltage is a voltage (potential difference) that does not cause the occurrence of back corona, and the output current is controlled so as to maintain the output voltage Vbc at this time. Thereby, the output voltage in the second period of time T2-2 can be made an appropriate value that can charge a collection target portion without causing back corona to occur. Note that, the reason for using the slope of an output voltage decrease to determine a voltage that does not cause the occurrence of back corona is that, since the size of the voltage Vbc that does not cause the occurrence of back corona varies depending on characteristics of the dry electrostatic precipitator 10 and the state of the load and the like, it is difficult to accurately determine the size of the voltage Vbc in advance.

Note that, the prescribed value of the slope may be determined experientially or may be determined based on simulation or the like.

Further, in a case of the dry electrostatic precipitator 10 in which changes in the characteristics and the state of the load and the like are small, a configuration may be adopted in which the voltage Vbc is determined in advance and is not determined based on the slope of an output voltage decrease, the power supply control apparatus 30 stores the voltage Vbc, and the output current is adjusted so as to obtain the stored voltage Vbc.

Further, in step 110 to step 118, in a case where the slope of an output voltage decrease has become less than or equal to the prescribed value, after outputting a current so as to obtain the initial value or previous optimal value of DCBC, the high voltage power supply 26 adjusts the current so as to obtain the voltage Vbc at the time point at which the voltage became equal to or less than the prescribed value. The initial value of DCBC is previously set so as to become an output voltage that is approximate to the voltage Vbc.

Accordingly, in the case of transitioning to the second period of time T2-2, since a voltage that is approximate to the voltage Vbc is output, without a time delay from the high voltage power supply 26 and is thereafter controlled so as to become the voltage Vbc, the power supply can output an appropriate voltage earlier in the second period of time T2-2.

As described above, in the charging time period T1, the dry electrostatic precipitator 10 according to the present embodiment outputs DCON that is a current for charging the collection target object from the high voltage power supply 26. Further, in the second period ox time T2-2 which is after the first period of time T2-1 passes from the time the charging pause time period T2 starts, the dry electrostatic precipitator 10 outputs a current DCBC that is less than DCON and is greater than the current in the first period of time T2-1 from the high voltage power supply 26.

Accordingly, the dry electrostatic precipitator 10 according to the present embodiment suppresses the occurrence of back corona, and can also suppress a decrease in the dust collection performance caused by charging pauses during intermittent charging.

While the present invention has been described above using the foregoing embodiment, the technical scope of the present invention is not limited to the scope described in the foregoing embodiment. Various changes or improvements that do not depart from the scope of the invention can be made to the foregoing embodiment, and forms including, such, modifications or improvements are also included in the technical scope of the present invention. Further, a plurality of the embodiments described above may be combined.

For example, although a form in which the present invention is applied to the dry electrostatic precipitator 10 is described in the foregoing embodiment, the present invention is not limited thereto, and a form may also be adopted in which the present invention is applied to a wet electrostatic precipitator.

Further, the flow of processing of the intermittent charge control program described in the foregoing embodiment is one example, and unnecessary steps may be deleted, new steps may be added, and the order of processing may be changed within a range that does not deviate from the scope of the present, invention.

REFERENCE SIGNS LIST

10 Dry electrostatic precipitator
20 Earth electrode
21 Application electrode
26 High voltage power supply

The invention claimed is:

1. A charge control method for an electrostatic precipitator whereas the electrostatic precipitator comprises a first electrode and a second electrode that are arranged to oppose each other along a circulation direction of a gas flow form an electrical field for charging a collection target object contained in the gas flow and collecting the collection target object by means of an electrostatic force, and a power supply that applies a potential difference between the first electrode and the second electrode so as to repeat a charging time period and a charging pause time period, whereas after a first period of time passes from a time that starts the charging pause time period, a second period of time occurs, and the charge control method comprising method steps of:

in the charging time period, the power supply outputs a predetermined current for charging the collection target object and;

in the second period of time the power supply outputs a second current that is less than the current in the charging time period, which is the predetermined current, and greater than a first current in the first period of time;

wherein, a slope of an output voltage decreases after a time that the charging pause time period starts, the slope becomes equal to or less than a prescribed value, and the power supply increases an output current to obtain an output voltage that is equal to or less than the slope for the prescribed value and starts the second period of time.

* * * * *